US005268195A

United States Patent [19]

Weisskopf

[11] Patent Number: 5,268,195

[45] Date of Patent: Dec. 7, 1993

[54] METHOD AND APPARATUS FOR PRODUCING FINELY PULVERIZED SAND PARTICLES FOR USE IN THE PRODUCTION OF CASTING MOLDS AND FOR COATING WITH THE FINELY PULVERIZED SAND PARTICLES MODELS FOR SHAPED CASTINGS

[75] Inventor: Hans Weisskopf, Stuttgart, Fed. Rep. of Germany

[73] Assignee: Mahle-J. Wizemann GmbH & Co. KG, Stuttgart, Fed. Rep. of Germany

[21] Appl. No.: 900,239

[22] Filed: Jun. 17, 1992

[30] Foreign Application Priority Data

Jun. 18, 1991 [DE] Fed. Rep. of Germany ..... 4120026

[51] Int. Cl.[5] ..... B05D 7/24; B05C 5/00

[52] U.S. Cl. ..... 427/134; 427/180; 118/308; 118/608; 164/5; 241/DIG. 10

[58] Field of Search ..... 118/308, 608; 241/DIG. 10; 164/5; 427/133, 134, 135, 180

[56] References Cited

U.S. PATENT DOCUMENTS

| | | | |
|---|---|---|---|
| 1,714,830 | 5/1929 | Wadsworth | 241/DIG. 10 |
| 2,321,082 | 6/1943 | Harshberger | 118/308 |
| 2,681,637 | 6/1954 | Simpson | 118/308 |
| 3,948,447 | 4/1976 | Jacob | 241/DIG. 10 |
| 3,986,675 | 10/1976 | Egland | 241/DIG. 10 |
| 4,334,574 | 6/1982 | Rennie et al. | 164/5 |
| 4,401,279 | 8/1983 | DeVita et al. | 241/236 |

FOREIGN PATENT DOCUMENTS

| | | | |
|---|---|---|---|
| 228468 | 10/1985 | Fed. Rep. of Germany | 164/5 |
| 52-39645 | 10/1977 | Japan | 241/DIG. 10 |

OTHER PUBLICATIONS

Bordt, H. et al., "Homogeneously Coating a Surface with Powder," IBM Technical Disclosure Bulletin, vol. 16, No. 10 (Mar. 1974) p. 3276.

*Primary Examiner*—Terry J. Owens
*Attorney, Agent, or Firm*—Barry R. Lipsitz

[57] ABSTRACT

Finely pulverized facing sand particles are provided for the production of casting molds in metal foundries. A feed device passes a bed of molding sand containing lumps to a refining device. The refining device includes a plurality of refining elements on a carrier. The refining elements are movable along an orbital path to remove lump-free facing sand particles from the bed of sand and deliver these in a free falling stream of finely pulverized facing sand particles. The refining elements are spaced on the carrier and the carrier is moved at a speed to maintain the spaces free of lumps.

29 Claims, 4 Drawing Sheets

METHOD AND APPARATUS FOR PRODUCING FINELY PULVERIZED SAND PARTICLES FOR USE IN THE PRODUCTION OF CASTING MOLDS AND FOR COATING WITH THE FINELY PULVERIZED SAND PARTICLES MODELS FOR SHAPED CASTINGS

BACKGROUND OF THE INVENTION

The invention relates to an apparatus for producing fine or small facing sand particles, in particular those of greensand, for the production of casting molds in metal foundry techniques, comprising a feed device, with which molding sand containing lumps can be passed to a refining means in a refining device.

In foundries, the so-called greensand molding sands are customarily reprocessed in mixers. These mixers normally operate according to the pan system with rollers or with turbine-type centrifugal separators and even with both systems.

Often, the molding sand prepared in this way is still not adequate to the requirements of the molding shop and so the molding sand is subsequently centrifuged.

Despite this procedure molding sand treated in this manner still contains lumps.

A molding sand containing lumps is not suitable for the production of finely contoured, filigrane casting molds since the casting molds which can be produced with this sand do not have any sharp outlines. It is therefore still necessary to pulverize the molding sand containing the lumps in addition.

One possibility of pulverizing this molding sand is described in DE-PS 12 88 754. The apparatus described in this publication is not capable of pulverizing the lumps of the molding sand to any satisfactory extent. In particular, the use of baffle boards for breaking up lumps has not brought the desired effect to any adequate degree since the lumps become compressed when beaten.

So far, the only satisfactory possibility of pulverizing the molding sand containing lumps is to first screen out the lumps in fine vibration sifters prior to coating the model and then break these lumps up. Such a screening of the sand containing lumps is extremely complex and mostly requires an additional operator who presses the lumps by hand onto the fine-meshed screens. Moreover, residue must be removed from the screens and, finally, such fine-meshed screens always tend to become clogged since the molding sand always shows a tendency to remain adhered to the meshing of the screen.

Facing sand particles are particles which comprise a quartz sand grain sheathed in clay or an agglomeration of several quartz sand grains each sheathed in clay and have, for example, in the fine state an average diameter of less than 1 mm or, even better, less than 0.5 mm, when the grain size of the quartz sand grains is from 0.04 to 0.4 mm.

The object underlying the invention is therefore to create an apparatus which enables finely pulverized facing sand particles to be produced from molding sand produced in a normal way but containing lumps.

SUMMARY OF THE INVENTION

This object is accomplished in accordance with the invention, for an apparatus of the type described at the outset, in that the feed device passes the molding sand containing lumps as a bed of sand to the refining means, that the refining means comprises a plurality of refining elements arranged on a carrier, that the refining elements are movable on an orbital path due to movement of the carrier and thereby remove lump-free facing sand particles from the bed of sand and deliver these in a stream of finely pulverized molding sand particles and that the refining elements during removal of the facing sand particles from the bed of sand are arranged on the carrier with such spaces and are movable on the orbital path at such a speed that the spaces remain free of lumps.

With this inventive apparatus it is possible, in a simple manner, to produce the finely pulverized molding sand particles, which are suitable for coating finely contoured, filigrane models, with little resources and without problem, and without the refining elements becoming filled with molding sand particles and blocking up. This is prevented by the refining elements being moved on the orbital path and thus the facing sand particles penetrating between these elements are always removed during movement along the orbital path.

When the refining elements move with an adequately high speed along the orbital path, the spaces between them can be larger than the average size of the lumps since, due to the rapid movement of the refining elements, the lumps from the bed of sand can be prevented from entering the spaces in these refining elements. However, if the speed, with which the refining elements move along the orbital path, is intended to be variable so it can be adapted to other parameters, the refining elements are preferably arranged on the carrier with spaces which are smaller than an average size of the lumps. If, in this case, the refining elements are moved at an adequate speed along the orbital path, the lumps can certainly be prevented from penetrating the spaces.

Since the lumps customarily have the size of peas or are somewhat larger, the refining elements are preferably arranged on the carrier with spaces which are smaller than 10 mm. It is even better for the spaces to be smaller than 5 mm.

In order for the refining elements to be able to remove facing sand particles from the bed of sand to an adequate extent, the refining elements preferably have, in the inventive solution, removing regions at their front ends remote from the carrier. These regions are movable over the bed of sand so as to engage therewith and hereby remove the facing sand particles from the bed of sand, in particular from the lumps in the bed of sand.

So that the lumps in the bed of sand can be broken up to an even better extent, it is also favourable for the refining elements to have at their front ends sections which penetrate into the lumps of the molding sand and hereby destroy them. These sections can preferably be produced in that the refining elements are provided, for example, with sharp edges or tips, with which they penetrate the lumps when they are moved through the bed of sand and are then in a position to break these lumps up into facing sand particles which have a facing sand particle size adequate for the finely pulverized facing sand.

An embodiment of the refining elements is particularly preferred, in which the removing regions coincide with the sections penetrating the lumps of the molding sand so as to destroy them.

With respect to the arrangement of the refining elements, no further details have so far been given. In an advantageous embodiment, the refining elements extend in a first direction transverse to a direction of movement of the orbital path.

In an additional, improved variation, the refining elements have, in a second direction extending transversely to the first, a dimension which is smaller than an average diameter of the lumps. A design of the refining elements of this type is particularly advantageous when these are intended to be provided such that they are capable of penetrating into the lumps to disperse them.

In an advantageous variation, the refining elements of the refining means are arranged with a constant density. Another advantageous solution provides for an arrangement of the refining elements with a variable density, in particular an alternating density.

In this respect, it is expedient for the second direction to extend parallel to the direction of movement.

It is particularly advantageous for the dimension of the refining elements in the second direction to correspond to an integral fraction of an average diameter of the lumps.

With respect to the alignment of the refining elements, no details have so far been given. It is, in this respect, favourable for the refining elements to be aligned in a defined manner relative to their direction of movement, preferably at right angles hereto, to obtain constantly defined relationships during removal of the facing sand particles from the bed of sand.

In a variation of the refining elements which is preferred within the scope of the present invention, these elements are of a bristle-like design.

A bristle-like design can be understood to cover diverse variations of cross-sectional shapes for the refining elements. For example, these can have rectangular, round, oval or other types of cross section.

In the simplest case, however, the refining elements are bristles of the carrier designed as a bristle carrier. For example, the refining means is designed in this case as a brush or brush roller which is caused to rotate. In this case, a rotating brush is particularly preferred which has, in the simplest case, bristles arranged at a constant density. However, the bristles can also be preferably arranged on a helical line.

A multitude of materials, which have an adequately large abrasive resistance in relation to the facing sand, can be used as bristle material. This is, for example, plastic. Even more advantageous is metal, in particular steel.

In another preferred alternative for the refining elements, these are vane-like in design. This means that these protrude like vanes or fins from the carrier and are movable with their front edges remote from the carrier along the bed of sand to remove the facing sand particles.

Particularly preferred is an embodiment, in which the refining elements are vanes which protrude from a disc carrier, for example, a cylinder.

With respect to the material of the refining elements, no exact details have so far been given. It is, for example, advantageous for the refining elements to be produced, in particular from metal, so as to be flexible and therefore wear out less easily.

Moreover, the flexibility of the refining elements has the advantage that the refining elements, when moving along the bed of sand, move into a removing position and subsequently into a starting position again and this means that facing sand particles adhering thereto will be detached and so, altogether, any clogging of the refining means is prevented.

In the embodiments described thus far, no details have been given regarding the outer shape of the refining elements. The refining elements could, for example, extend at different lengths from the carrier. Particularly preferred is, however, an embodiment, in which the refining elements form with their front ends a uniform surface of the refining means which is of a fixed arrangement, in particular in relation to the bed of sand.

This surface of the refining means is expediently a cylindrical surface.

With respect to the type and arrangement of the carrier, no details have so far been given. It would, for example, be possible to design the carrier as a type of conveyor belt, from which the refining elements protrude. From a constructional point of view, it is, however, easier to have the carrier rotating about an axis.

In all the embodiments described thus far, it has merely been assumed that the refining device operates to a satisfactory degree due to the fact that it removes the facing sand particles from the bed of sand passed to it. The refining means is hereby designed such that it merely removes from the bed of sand facing sand particles which are smaller than the lumps and this prevents the refining elements taking the lumps along during their movement on the orbital path. However, in order to ensure that lumps are prevented from occurring in the stream of finely pulverized facing sand, which is as such free of lumps, the refining device is preferably provided with a gap which, on the one hand, is limited by a surface of the refining means and through which the refining elements move the facing sand particles removed from the bed of sand This gap provides a possibility of prohibiting the refining elements from taking along lumps in an undesired manner.

Preferably, the width of the gap is smaller than an average diameter of the lumps. The width of the gap is, in particular, dimensioned such that it corresponds at the most to the diameter of the particles desired in the stream of finely pulverized facing sand particles.

Within the scope of the present invention, it would be conceivable to have additional elements arranged after the gap. However, it is particularly advantageous, especially for avoiding any renewed formation of lumps, for the stream of finely pulverized facing sand particles to exit from the gap and to be freely movable proceeding, in particular, from the gap.

In particular, individual facing sand particles in the stream each have a different direction of flight so that casting shadows are avoided hereby during coating of the model. Preferably, the distribution of the individual directions of flight in the stream results in a cone-like distribution, in which all the directions located within a cone occur.

As mentioned above, the gap is limited on the one hand by the surface of the refining means. However, nothing has been said about the limitation of the gap on the other side. In the simplest case, it is possible for the gap to be limited by a wall on the side opposite the refining means. Alternatively, it is also conceivable in a different embodiment of the inventive solution for the gap to be limited on the side opposite the refining means by an additional refining means, whereby the refining elements of the two refining means can be moved in contrary directions of rotation or, preferably, in the same direction. In any case, it is ensured by the gap that no lumps in the molding sand are movable through the gap by the refining elements. Alternatively to the gap, a "meshing" of the refining elements of refining means located adjacent one another is provided in an additional, advantageous variation.

In the embodiments described thus far, the feed device has not be specified in greater detail. In a preferred embodiment, the feed device comprises a dosing device for passing the bed of sand to the refining means in regulated quantities.

It is possible to present the bed of sand in a regulatable manner, the bed of sand in this case representing a travelling bed, when, for example, the dosing device is a conveyor belt.

In addition to the solution described above, the object specified at the outset is also accomplished, in accordance with the invention, by an apparatus for coating bodies arranged on pattern plates with finely pulverized facing sand particles for the production of casting molds in iron foundries, comprising a feed device for passing molding sand containing lumps to a refining device movable above the body, in that the refining device comprises a refining means with refining elements movable on an orbital path and delivering the molding sand containing lumps as a lump-free stream of facing sand particles, that the lump-free stream has an elongated cross-sectional form with a facing sand particle density substantially constant over this cross-sectional form, that the lump-free stream drops without deflection—i.e. without mechanical deflection—from the refining means into the body and that the refining device is movable relative to the body in a distribution direction extending transversely to the elongated cross-sectional form for even spreading of the finely distributed facing sand onto the body.

With this inventive solution it is ensured that the bodies, which are either models for shaped castings or models provided with inlaid iron chills, in particular for chilled cast engineering casting, are covered with a substantially constant layer of finely distributed facing sand. This is, in particular, of considerable importance for a subsequent compression of the sand by a surge of air or an air current in order to finally obtain a casting mold with contours which are as exact as possible.

In this respect, it is particularly advantageous for the refining elements to remove lump-free facing sand particles from a bed of sand passed to the refining means from the feed device and during removal of the facing sand particles from the bed of sand to be arranged on a carrier with such spaces and be movable on the orbital path at such a speed that the spaces remain free of lumps.

Additional embodiments of this apparatus have the same features as those described in conjunction with the apparatus specified at the outset.

Furthermore, the object cited at the outset is also accomplished, in accordance with the invention, by a method for coating a body having large contour variations with facing sand particles, in particular facing sand particles of greensand, during the course of production of a casting mold for shaped castings, in that molding sand containing lumps is fed as a bed of sand to a refining device and that in the refining device lump-free facing sand particles are removed from the bed of sand by refining elements moving on an orbital path and a lump-free stream of facing sand particles is formed and that with the stream the body is covered directly with a loose layer of finely pulverized facing sand particles.

The method is particularly effective when the directions of flight of the individual facing sand particles are not the same but differ relative to one another and, for example, are located within a cone. This enables casting shadows to be avoided during coating of the body.

This creates, in particular, the prerequisites for an exact coating of the body contours and a subsequent, uniform compression of the layer which is a prerequirement for a shaped casting with exact contours and a good surface quality. The surface quality, in particular, is only good when the density of the layer after compression, for example by a surge of air or an air current or with a jolting table, is essentially constant in order to enable air to escape from the casting mold produced.

The inventive method is particularly advantageous when the body is a model having iron chills placed thereon and when the layer of finely pulverized facing sand particles is applied such that this coats the outline of the iron chills and the model essentially exactly. In this case, the production is preferably of chilled cast engineering castings, in which the iron chills placed on the model must be precisely molded with the model to prevent, inter alia, any ridge formation on the later cast piece which results from the iron chills not being molded exactly to their contours by the facing sand.

In another embodiment of the inventive method, the body is a model, in particular with a filigrane contour, for which it is important to coat the filigrane contour with the facing sand quite exactly. This is, for example, the case in conventionally produced gray iron castings, in which the form and surface quality is intended to be as high as possible despite a filigrane contour.

In addition, it is advantageous, in the inventive method, for the lump-free facing sand particles to be scraped from the lumps by the refining elements.

In an additional, alternative or complementary possibility for carrying out the inventive method, the lumps are comminuted by the refining elements piercing them.

Furthermore, it is advantageous for the molding sand to be moved by the refining elements through a gap which preferably has a gap width smaller than an average lump size.

In a particularly preferred embodiment of the inventive method, the lump-free facing sand particles are brushed from the bed of sand, for example by a rotary brush, in particular a steel brush.

In order to achieve a high cast quality, it is, in addition, of advantage for the layer to be applied with an essentially constant layer thickness.

Moreover, it is of advantage for a uniform spreading of the layer for the layer to be applied uniformly due to relative movement between the body and the stream.

Additional, advantageous variations of the inventive method have already been explained in conjunction with the features of the inventive apparatus, to which reference is made.

BRIEF DESCRIPTION OF THE DRAWINGS

Additional features and advantages of the inventive solution are the subject matter of the following description as well as of the drawings of several embodiments. In the drawings.

DETAILED DESCRIPTION OF THE PREFERRED EMBODIMENTS

Figure 1:
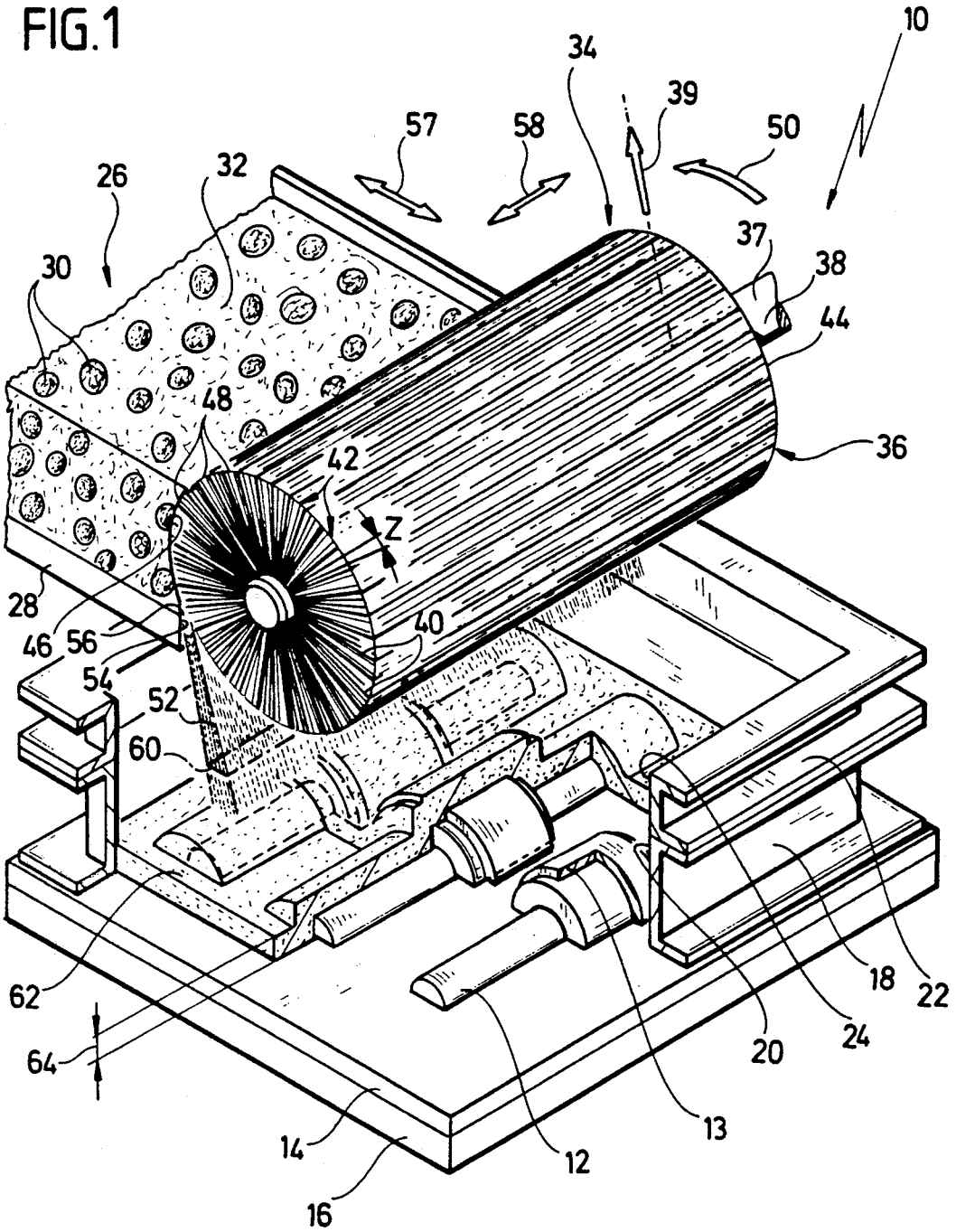
FIG. 1 shows a longitudinal section through a side view of a first embodiment of an inventive apparatus.

A first embodiment of an apparatus for producing finely pulverized facing sand particles, in particular of facing sand particles of greensand, for the purpose of directly coating a model or pattern 12 with an iron chill 13 placed thereon, is illustrated in FIG. 1 and designated as a whole as 10.

For the production of a casting mold—in this case for chilled iron engineering castings—, the model 12 with the iron chill 13 placed thereon is arranged on a pattern plate 14 which, for its part, is located on a molding machine table 16. The model 12 with the iron chill 13 is seated on the pattern plate 14, surrounded by a casting box 18 which has an upper opening 20. A filling frame 22 is seated in addition on this casting box 18. The filling frame has the same interior cross section as the casting box 18 and, for its part, has a feed opening 24 for introducing the molding sand into the casting box 18 and the filling frame 22.

The inventive apparatus 10 comprises a feed device designated as a whole as 26 which, in the simplest case, is designed as a feed chute 28, and passes the molding sand containing lumps 30 to a refining device 34 with a refining means 36 in the form of a bed 32 of sand.

The refining means 36 is designed, in the simplest case, as a brush roller which comprises a carrier 38 and bristles, in particular wire bristles, serving as refining elements 40, the bristles preferably protruding at right angles from a surface 37 of the carrier 38 in radial direction 39 and being located with their outer ends 42 in a cylindrical surface 44.

The refining means 36 is arranged such that the cylindrical surface 44 passes by a front side 46 of the bed 32 of sand, and such that side edges of the bristles 40 forming a removing region 48 engage with the ends 42 in the bed 32 of sand at the front side 46 thereof and remove facing sand particles from this bed of sand.

In addition, the bristles 40 are dimensioned in the region of their ends 42 such that their extension transversely to the radial direction 39 is smaller than an average diameter of the lumps 30 in the bed 32 of sand so that the bristles 40, when penetrating with their ends 42 into the bed 32 of sand at its front side 46, also partially penetrate into the lumps 30 located at the front side 46, break these up and thereby produce finely pulverized facing sand particles.

In accordance with the invention, the refining means 36 rotates with a direction of rotation 50 such that the ends 42 brush past the front side 46 from top to bottom in a manner to penetrate into the bed 32 of sand and take facing sand particles down with them at the front side 46 and, following the bed 32 of sand, provide finely pulverized facing sand particles in a stream 52.

The bristles 40 which therefore move on an orbital path are arranged on the carrier 38 and rotate with such a speed along their orbital path that the lumps 30 of the bed 32 of sand cannot penetrate into spaces Z between the ends 42 of the bristles 40 and so these spaces Z also remain free of lumps.

In order to prevent lumps 30 which are inadequately comminuted being pulled out of the bed 32 of sand by the ends 42 of the bristles 40 in the region of the front side 46, the chute 28 is pulled so far forward that it extends, with a front edge 54, parallel to the cylindrical surface 44 and thereby leaves a small gap 56 open, which is smaller than an average diameter of the lumps 30, preferably smaller than the smallest lump diameter. The gap 56 therefore limits the bed of sand 32 as well and retains the molding sand containing lumps 30 so that the facing sand particles which are removed due to the action of the bristles 40 rotating on the orbital path are moved through the gap 56 and exit from this gap 56 in the form of the stream 52.

As illustrated in FIG. 1, the feed device 26 and also the refining device 34 are arranged such that the facing sand particles in the stream 52 fall without deflection into the feed opening 24 of the filling frame 22 and, therefore, also into the opening 20 of the casting box 18 and thus cover the model 12 on the pattern plate 40 in free fall and coat this exactly to its shape due to the fineness of the facing sand particles.

Preferably, the feed device 26 and the refining device 34 are movable for this purpose in a longitudinal direction 56 which extends parallel to a side wall of the casting box 18 and extend in a transverse direction 58 at right angles to the longitudinal direction 57. This transverse direction preferably extends parallel to an additional side wall of the casting box 18, to such an extent that the stream 52 has a cross section 60 which is elongated in the transverse direction 58 and which extends in the transverse direction 58 preferably over the entire width of the casting box 18 in this direction. This means that the model 12 can be coated with a layer 62 of finely pulverized facing sand due to a single or multiple movements of the feed device 26 with the refining device 34 in the longitudinal direction 57, the layer 62 thereby having, in accordance with the invention, an essentially constant layer thickness 64 over the model 12.

The refining means 36 is driven by a motor, which is not illustrated in FIG. 1 of the drawings, in accordance with the invention such that the bristles 40 rotate at a high speed on their orbital path. At the same time, the refining means 36 is rigidly but adjustably arranged relative to the feed device 26 and movable by a drive, also not illustrated in the drawings, together with the feed device 26 in the longitudinal direction 57 so that the gap 56 always has a constant width.

A second embodiment of an inventive apparatus, illustrated in FIG. 2 and designated as a whole as 70, is given the same reference numerals insofar as the parts used are the same as in the first embodiment and so in this respect reference can be made to the explanations regarding the first embodiment.

This second embodiment 70 of the inventive apparatus comprises a pair of guide rails 72, on which a carriage 74 is movable with rollers 76 in the longitudinal direction 57. The carriage 74 has a carriage frame 78, on which the rollers 76 are mounted. In addition, two conveyor belt drums 80 and 82 are rotatably mounted on the carriage frame 78 in spaced relation to one another, a conveyor belt 84 running over and extending between these two conveyor belt drums 80 and 82. The conveyor belt 84 and the conveyor belt drums 80 and 82, which are preferably drivable via a motor 86, hereby form the feed device 26.

By moving the carriage 74 beneath a discharge opening 88 of a sand bin 90, the bed 32 of sand can be spread on an upper track 92 of the conveyor belt 84. The bed 32 of sand extends from the front conveyor belt drum 82 facing the casting box 18 as far as the rear conveyor belt drum 80 and in the region of the rear conveyor belt drum 80 is preferably limited by a guard 94 located above the upper track 92.

The refining means 36 of the refining device 34 is also rotatably mounted on the carriage frame 78, on a side of the conveyor belt drum 82 which faces the casting box 18 and over which a section 96 of the conveyor belt 84 facing the casting box 18 extends.

The cylindrical surface 44 of the refining means 36 preferably extends at a slight distance from the section 96 so that, on the other hand, it forms the gap 56 with this section 96.

By moving the upper track 92 of the conveyor belt 84 in the direction of the casting box 18, the bed 32 of sand can be fed to the refining means 36 in the form of a travelling bed, and in such a manner that the bed of sand, when spread on the upper track 92, extends as far as the cylindrical surface 44 and with its front side 46 faces the refining means 36. This means that the refining means, as described in conjunction with the first embodiment, refines the molding sand containing lumps 30 by removing facing sand particles in the region of the front side 46, moves these facing sand particles through the gap 56 and lets these fall onto the model 12 in the form of a stream 52.

In the second embodiment, illustrated in FIG. 2, a motor 98 is provided which directly drives the refining means 36 and causes the bristles 40 thereof to rotate at a high speed on their orbital path.

Figures 2A, 2B, 2C:
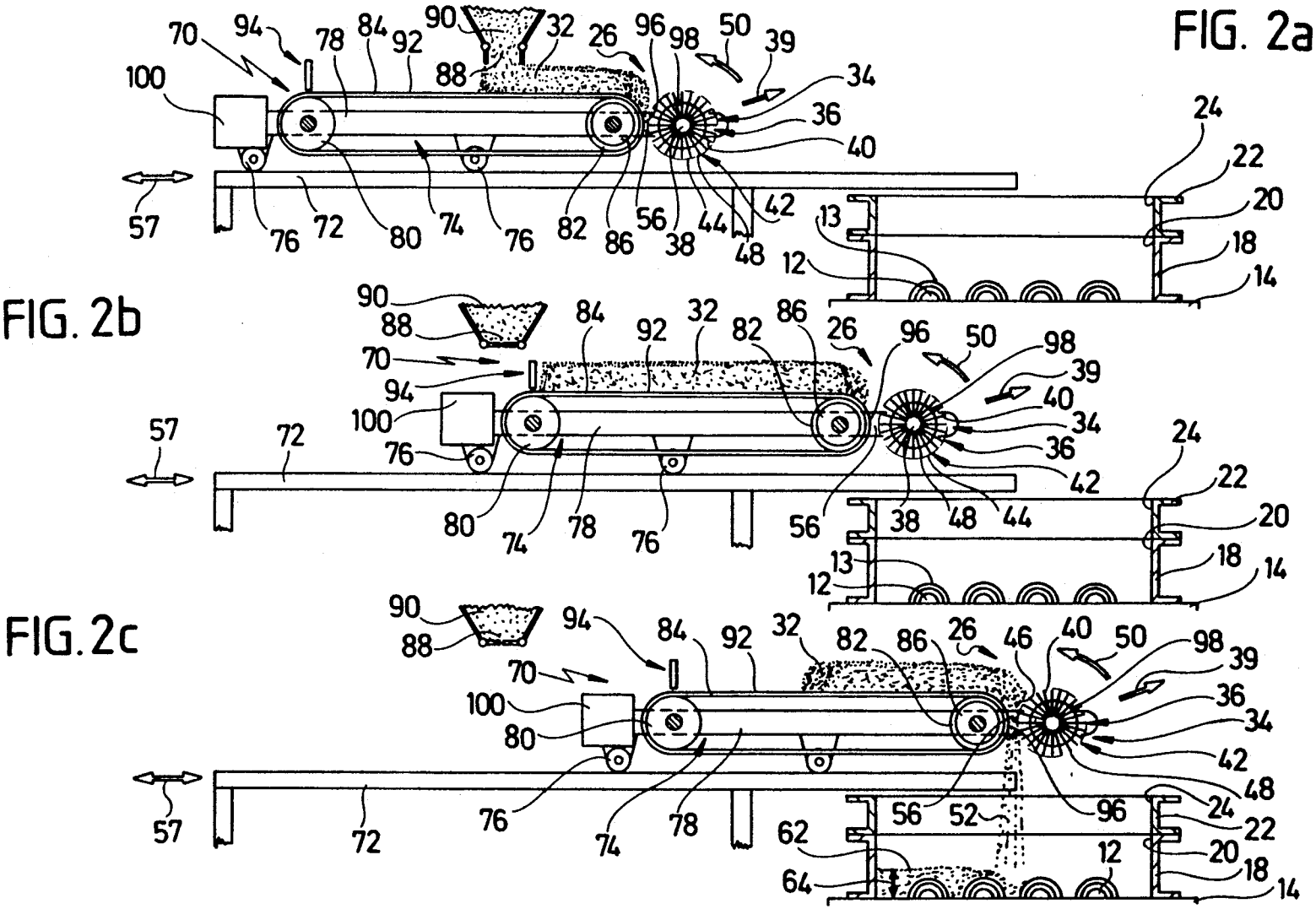
FIGS. 2*a*, 2*b* and 2*c* are side views of a second embodiment of an inventive apparatus.
Figure 3:
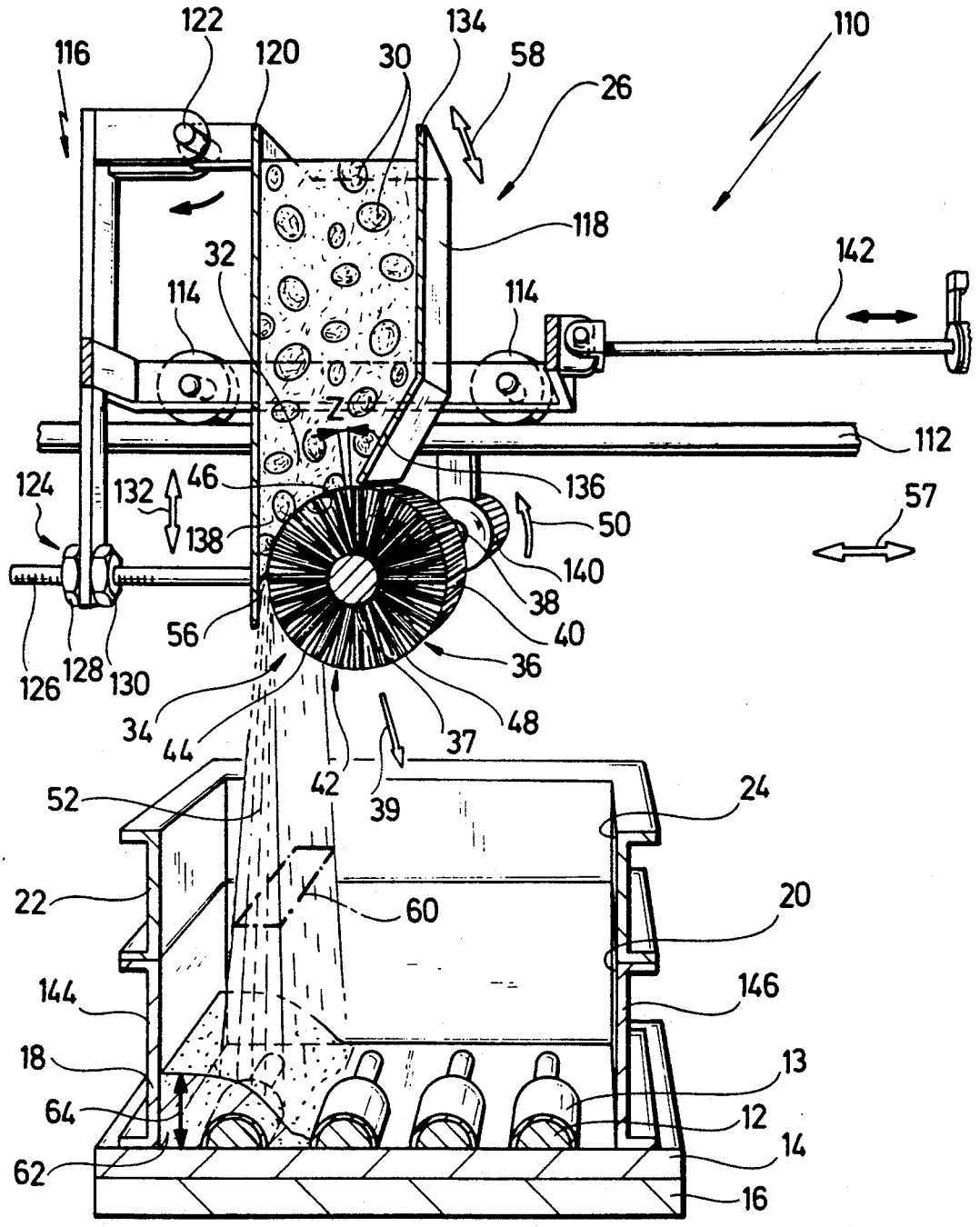
FIG. 3 is a longitudinal section through a third embodiment of an inventive apparatus.

The embodiment illustrated in FIG. 2 operates as follows:

For spreading the bed 32 of sand onto the upper track 92 of the conveyor belt 84, the carriage 74 is moved back in the longitudinal direction 57 to such an extent that the front conveyor belt drum 82 is located approximately beneath the discharge opening 88 of the sand bin 90. The refining means 36 is not driven at this time but is stationary. The conveyor belt 84 is also not driven by the motor 86. Only a carriage drive 100 displaces the carriage beneath the discharge opening 88 of the sand bin 90 such that the front conveyor belt drum 82 is moved away from the discharge opening 88 and the rear conveyor belt drum 80 moved towards this. As illustrated in FIG. 2*a*, the bed 32 of sand is thereby spread on the upper track 92 with a preferably uniform thickness, whereby this extends in the spread state as far as the guide 94, as illustrated in FIG. 2*b*.

This means that the feed device 26, formed by the conveyor belt 84 and the conveyor belt drums 80 and 82, is provided with the bed 32 of sand.

The carriage 74 is now moved by the carriage drive 100 for such a distance in the longitudinal direction 57 towards the casting box 18 until the gap 56 is located approximately over the feed opening 24 in the region of a side wall of the casting box 18, in this case the side wall closest to the carriage 74, which extends parallel to the transverse direction 58.

In this position, the conveyor belt 84 is now driven by the motor 86 such that its upper track 92 is moved towards the refining means 38. In addition, the refining means 36 is caused to rotate by the motor 98, and with the same direction of rotation 50 as in the first embodiment, i.e. such that the bristles 40 move from top to bottom along the front side 46 of the bed 32 of sand and pass the facing sand particles removed therefrom through the gap 56 into the stream 52.

The bed 32 of sand now runs in the form of a travelling bed in the direction towards the refining means 36 to the extent to which facing sand particles are removed from the front side 46 thereof by the refining means 36 and passed into the stream 52.

Proceeding from this position, the carriage 74, as illustrated in FIG. 2*c*, is now moved by means of the carriage drive 100 slowly in the longitudinal direction 57 towards the oppositely located side wall of the casting box 18, and preferably at a constant speed, so that the model 12 in the casting box 18 is likewise coated with the layer 62 and a constant layer thickness 64.

As soon as the gap is located above the feed opening 24 and close to the oppositely located side wall of the casting box 18, the conveyor belt 84 and the refining means 36 are stopped and the carriage 74 again moved by the carriage drive 100 in the longitudinal direction 57 to beneath the discharge opening 88 of the sand bin 90 for applying the bed 32 of sand.

Preferably, during the coating process the conveyor belt 84 is moved at such a speed that the entire bed of sand 32 spread on the upper track 92 is used up for coating the model 12.

In a third embodiment of an inventive apparatus designated as a whole as 110, a pair of guide rails 112 extending above the casting box and the filling frame 22 is also provided and a carriage 116 is displaceable on this pair of guide rails by means of rollers 114. This carriage 116 bears as feed device 26 a sand container 118, comprising a container wall 120 extending in the transverse direction 58 transversely to the longitudinal direction 57. This wall is pivotally mounted on the carriage 116 by means of a joint 122 and is adjustable in its alignment to the vertical 132 by means of an adjusting means 124, for example formed by a threaded rod 126 and nuts 128 and 130 seated thereon. The container wall 120 extends essentially in the direction of the vertical 132.

A container wall 134 of the sand container 118 is provided opposite the container wall 120 and this extends with a lower section 136 towards the container wall 120 and forms together with this wall a lower opening 138 of the sand container 118.

The sand container 118 is filled with molding sand, in particular greensand, with the lumps 30. Due to the alignment of the sand container 118 essentially in the vertical 132, this molding sand has the tendency to exit out of the lower opening 138.

The refining means 36 described in the first embodiment is arranged in front of this lower opening 138, and such that its cylindrical surface 44 essentially extends directly beneath a lower edge of the section 136 and covers the lower opening 138 to a large extent, extends as far as the container wall 120 and forms with this the gap 56.

With respect to the construction of the refining means 36 reference is made in full to the content of the explanations concerning the first embodiment.

Beneath the lower opening 138 the bed 32 of sand is therefore formed facing the cylindrical surface 44 with its front side 46, past which the ends 42 of the bristles 40 are moved in the manner described and therefore remove facing sand particles and convey these through the gap 56 into the stream 52. For this purpose, the refining means 36 is rotated such that the bristles 40 move in front of the lower opening 138 from the lower edge of the section 136 towards the container wall 120 and to the gap 56.

The refining means 36 is, for its part, again driven via a motor 140 and rotatably mounted on the carriage 116 so that it is movable in the longitudinal direction 57 together with the sand container due to movement of the carriage via a feed drive 142.

The adjustability of the container wall 120 via the adjusting means 124 now serves to regulate the size of the gap 56.

For coating the model 12 in the third embodiment 110, the entire carriage 116 is displaced such that the stream 52 is located over the feed opening 24, for example close to the left side wall 144 of the casting box 18. In this position, the refining means 36 is caused to move by the motor 140 such that the bristles 40 remove the facing sand particles from the bed 32 of sand and pass these into the stream 52 in the manner already described in conjunction with the first embodiment. The feed drive 142 now moves the carriage 116 preferably at a constant speed in the longitudinal direction 57 so that the stream 52 travels from the left side wall 144 to the right side wall 146 of the casting box 18 and the model is covered with the layer 62 of most finely broken up facing sand. As soon as the stream 52 is located directly adjacent the right side wall 146, the motor 140 is switched off so that the refining means 136 is stationary and no more facing sand falls into the casting box 18.

Figure 4:
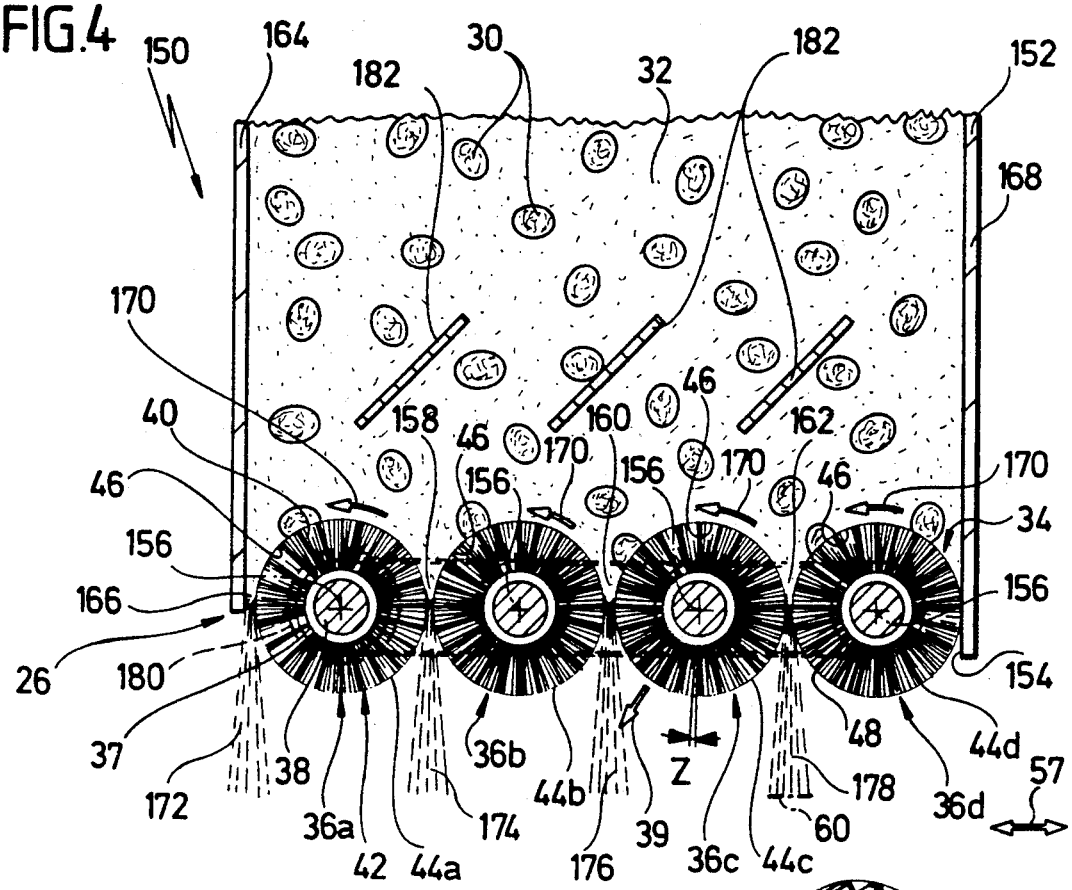
FIG. 4 is a longitudinal section through a fourth embodiment of an inventive apparatus and FIG. 5 is a variation of an inventive refining means.

A fourth embodiment of the inventive apparatus, illustrated in FIG. 4 and designated as a whole as 150, comprises a sand container 152 with a lower opening 154, in which four refining means **36*a* to 36*d* are arranged next to one another with axes of rotation 156 aligned parallel to one another, and such that the cylindrical surfaces 44*a* and 44*b*, 44*b* and 44*c*, 44*c* and 44*d* of adjacent refining means 36*a* and 36*b*, 36*b* and 36*c*, 36*c* and 36*d* form between them each time a gap 158, 160 and 162, respectively. In addition, the cylindrical surface 44*a* forms an additional gap 166 with a container wall 164 facing this surface while the cylindrical surface 44*d* does not form any gap with the container wall 168** associated with it.

The direction of rotation 170 of all the refining means **36*a* to 36*d* is the same and extends such that the refining means 36*a* moves facing sand particles through the gap 136 with its bristles 40, the refining means 36*b* facing sand particles through the gap 158, the refining means 36*c* facing sand particles through the gap 160 and the refining means 36*d* facing streams 172, 174, 176 and 178** result.

In this respect, all the refining means **36*a* to 36*d* are preferably driven by a single motor 180**.

Each single refining means **36*a* to 36*d* operates in the fourth embodiment 150 in the same manner as described in the first embodiment, whereby the bed 32 of sand is formed in front of each of the gaps 158, 160, 162 and 166 due to the molding sand following on in the sand container 152**.

In order to enable the forming sand in the sand container 152 to follow on in a manner directed to the individual beds 32 of sand in front of the individual gaps 158, 160, 162 and 166, fins 182 are provided in addition in the sand container 152.

In the fourth embodiment 150, the sand container 152 is arranged stationarily above the casting box 18 for the purpose of coating the model, the cross-sectional areas of the streams 172, 174, 176 and 178 being selected such that, altogether, they border on one another and the model 12 is coated with the layer 62 of a constant thickness.

Alternatively hereto, the sand container 152 is, in a variation, also movable in the longitudinal direction 57 relative to the model 12 so that a layer 62 having a constant layer thickness 64 over the model 12 can be achieved hereby.

Figure 5:
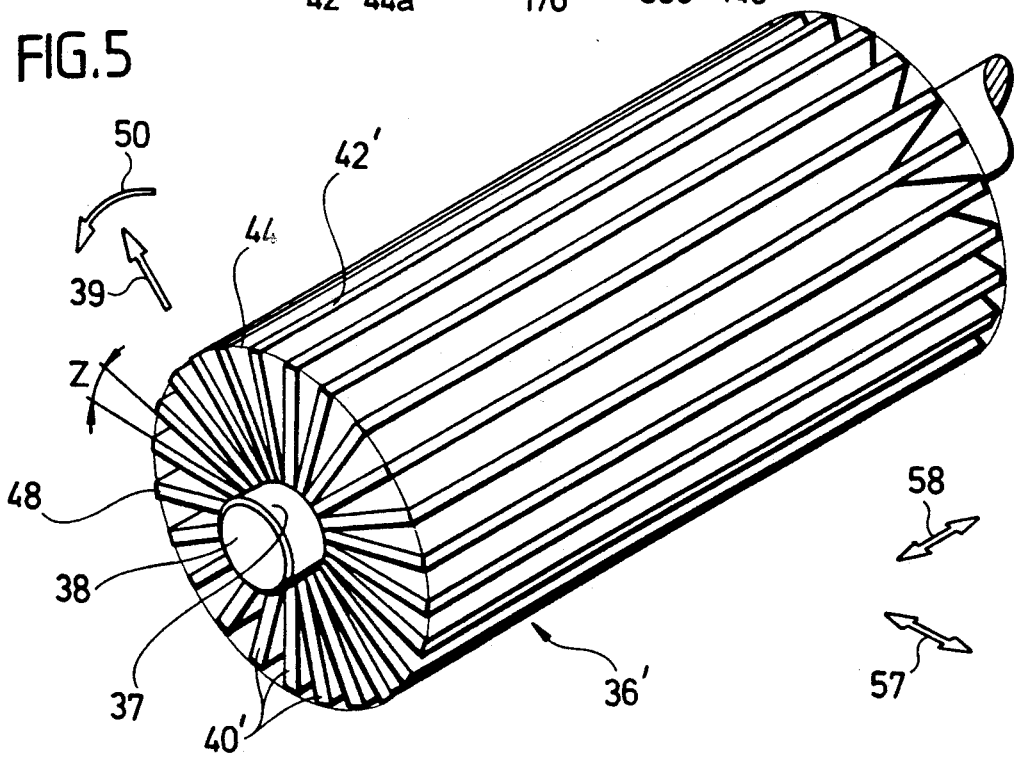

In a further variation 36' of an inventive refining means, illustrated in FIG. 5, the carrier 38 is provided with refining elements 40' designed as vanes, which also extend in the radial direction 39 of the carrier 38 and are located with their outer edges 42' in the cylindrical plane 44. In addition, the vanes 40' are dimensioned such that, in the direction of the direction of rotation 50, their thickness is many times smaller than an average diameter of the lumps 30 and so the outer edges 42' penetrate into the lumps 30 so as to destroy them when the vanes 40' are moved past at the front side 46 of the bed 32 of sand.

Moreover, the distance Z between the vanes 40' is selected such that this remains free of lumps at the respective rotational speed of the refining means 36'. Preferably, the dimension of the spaces Z is smaller than an average diameter of the lumps 30 in the bed 32 of sand.

What is claimed is:

1. Apparatus for producing finely pulverized facing sand particles for the production of casting molds in metal foundries, comprising a feed device for passing molding sand containing lumps to a refining means in a refining device;

said feed device passing said molding sand containing lumps as a bed of sand to said refining means;

said refining means comprising a plurality of refining elements arranged on a carrier;

said refining elements being movable along an orbital path due to movement of the carrier for removing lump-free facing sand particles from the bed of sand and delivering said lump-free particles in a free falling stream of finely pulverized facing sand particles;

said refining elements being arranged on said carrier with a spacing and being movable at a speed along said orbital path such that spaces between said refining elements remain free of lumps during removal of said facing sand particles from the bed of sand; and said refining device being provided with a gap limited on one side by a surface of said refining means adjacent said bed of sand, said facing sand particles being moved through said gap by said refining elements to form said stream of free falling finely pulverized facing sand particles;

wherein said free falling particles exit said refining means and drop on a model to be coated in a freely movable manner without impinging on any surface after exiting from said refining means.

2. Apparatus as defined in claim 1, characterized in that the refining elements are arranged on the carrier with spaces that are smaller than an average size of the lumps.

3. Apparatus as defined in claim 1, characterized in that the refining elements have front ends with sand particles removing regions at remote from the carrier.

4. Apparatus as defined in claim 1, characterized in that the refining elements have front end sections capable of penetrating and breaking up the lumps of the molding sand.

5. Apparatus as defined in claim 1, characterized in that the refining elements extend in a first direction transverse to their direction of movement along the orbital path.

6. Apparatus as defined in claim 5, characterized in that in a second direction extending transversely to the first direction refining elements have a dimension smaller than an average diameter of the lumps.

7. Apparatus as defined in claim 6, characterized in that the second direction extends parallel to the direction of movement.

8. Apparatus as defined in claim 6, characterized in that the dimension of the refining elements in the second direction is a fraction of an average diameter of the lumps.

9. Apparatus as defined in claim 1, characterized in that the refining elements are aligned in a defined manner relative to their direction of movement.

10. Apparatus as defined in claim 9, characterized in that the refining elements are aligned at right angles to their direction of movement.

11. Apparatus as defined in claim 1, characterized in that the refining elements comprise bristles.

12. Apparatus as defined in claim 11, characterized in that the refining elements are bristles of a bristle carrier.

13. Apparatus as defined in claim 1, characterized in that the refining elements comprise vanes.

14. Apparatus as defined in claim 1, characterized in that the refining elements are elastic.

15. Apparatus as defined in claim 14, characterized in that the refining elements are made of metal.

16. Apparatus as defined in claim 1, characterized in that the refining elements comprise front ends which are aligned to form a substantially uniform surface of the refining means.

17. Apparatus as defined in claim 16, characterized in that the substantially uniform surface of the refining means is a cylindrical surface.

18. Apparatus as defined in claim 1, characterized in that the feed device comprises a dosing device for passing the bed of sand to the refining means in regulated quantities.

19. Apparatus for coating bodies arranged on pattern plates with finely pulverized facing sand particles for the production of casting molds in metal foundries, comprising:

a refining device arranged above a body to be coated:

said refining device having a refining means comprising refining elements movable along an orbital path and delivering molding sand containing lumps as a lump-free stream of finely pulverized facing sand particles;

said lump-free stream having an elongated cross-sectional form and dropping in a freely movable manner from said refining means onto said body without deflection; and said refining device being movable relative to said body in a distribution direction extending transversely to said elongated cross-sectional form of said lump-free stream for application of the finely pulverized facing sand onto said body.

20. Apparatus as defined in claim 19, characterized in that the refining elements remove lump-free facing sand particles from a bed of sand passed from a feed device to the refining means, and during removal of the facing sand, particles from the bed of sand are arranged on a carrier with such spaces and are movable on the orbital path with such a speed that the spaces remain free of lumps.

21. Apparatus in accordance with claim 19, wherein:

said lump-free stream has a facing sand particle density that is substantially constant over said cross-sectional form for essentially evenly applying the finely pulverized facing sand onto said body.

22. A method for coating a body having contour variations with facing sand particles, during the course of production of a casting mold for shaped castings, comprising the steps of:

feeding a bed of molding sand containing lumps to a refining device;

removing lump-free facing sand particles from the bed of sand with refining elements moving on an orbital path in said refining device;

forming a lump-free stream of finely pulverized facing sand particles; and propagating said stream in a freely movable, free falling manner from said refining elements without deflection to a body so as to directly cover said body with a layer of said finely pulverized facing sand particles.

23. A method as defined in claim 22, characterized in that the body is a model having iron chills placed thereon and that the layer of the finely pulverized facing sand particles is applied to essentially exactly coat an outline of the iron chills and the model.

24. A method as defined in claim 22, characterized in that the body is a model for conventional shaped castings.

25. A method as defined in claim 22, characterized in that the lump-free facing sand particles are scraped from the lumps by the refining elements.

26. A method as defined in claim 22, characterized in that the lumps are pulverized by the refining elements piercing them.

27. A method as defined in claim 22, characterized in that the lump-free facing sand particles are brushed from the bed of sand by the refining elements.

28. A method as defined in claim 22, characterized in that the layer is applied with an essentially constant layer thickness.

29. A method as defined in claim 28, characterized in that the layer is applied essentially uniformly due to relative movement between the body and the stream.

* * * * *